US006317088B1

(12) United States Patent
Lindsay et al.

(10) Patent No.: US 6,317,088 B1
(45) Date of Patent: Nov. 13, 2001

(54) SATELLITE ANTENNA DEICING DEVICE

(76) Inventors: Joyce Y. Lindsay; Gary A. Lindsay, both of P.O. Box #219, New Pine Creek, OR (US) 97635

( * ) Notice: Subject to any disclaimer, the term of this patent is extended or adjusted under 35 U.S.C. 154(b) by 0 days.

(21) Appl. No.: 09/586,027

(22) Filed: Jun. 2, 2000

(51) Int. Cl.[7] ..... H01Q 1/02
(52) U.S. Cl. ..... 343/704; 343/840
(58) Field of Search ..... 343/704, 878, 343/840, 890; 219/203; 392/422

(56) References Cited

U.S. PATENT DOCUMENTS

| | | | | |
|---|---|---|---|---|
| D. 383,559 | | 9/1997 | Chan . | |
| 2,679,004 | | 5/1954 | Dyke et al. . | |
| 4,866,452 | | 9/1989 | Barma et al. . | |
| 5,010,350 | | 4/1991 | Lipkin et al. . | |
| 5,353,037 | | 10/1994 | Jones . | |
| 5,617,107 | | 4/1997 | Fleming . | |
| 5,729,238 | * | 3/1998 | Walton, Jr. | 343/704 |
| 5,729,241 | * | 3/1998 | Ergen et al. | 343/872 |
| 5,940,047 | * | 8/1999 | Pfnister | 343/872 |
| 6,084,550 | * | 7/2000 | Jones | 343/704 |
| 6,137,446 | * | 10/2000 | Jones | 343/704 |

* cited by examiner

*Primary Examiner*—Tan Ho

(57) ABSTRACT

A satellite antenna deicing device for preventing accumulation of ice and snow upon the reception side of the satellite dish. The satellite antenna deicing device includes a mounting bracket member adapted to be securely fastened to an elongate satellite antenna support member; and also includes an arm member having a first end securely attached to the mounting bracket member and having a second end; and further includes a heating assembly for heating the satellite antenna for the deicing thereof.

7 Claims, 1 Drawing Sheet

SATELLITE ANTENNA DEICING DEVICE

BACKGROUND OF THE INVENTION

1. Field of the Invention

The present invention relates to TV dish deicer and more particularly pertains to a new satellite antenna deicing device for preventing accumulation of ice and snow upon the reception side of the satellite dish.

2. Description of the Prior Art

The use of TV dish deicer is known in the prior art. More specifically, TV dish deicer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,353,037; 5,617,107; 4,866,452; 5,010,350; 2,679,004; and Des. 383,559.

While these devices fulfill their respective, particular objectives and requirements, the aforementioned patents do not disclose a new satellite antenna deicing device. The inventive device includes a mounting bracket member adapted to be securely fastened to an elongate satellite antenna support member; and also includes an arm member having a first end securely attached to the mounting bracket member and having a second end; and further includes a heating assembly for heating the satellite antenna for the deicing thereof.

In these respects, the satellite antenna deicing device according to the present invention substantially departs from the conventional concepts and designs of the prior art, and in so doing provides an apparatus primarily developed for the purpose of preventing accumulation of ice and snow upon the reception side of the satellite dish.

SUMMARY OF THE INVENTION

In view of the foregoing disadvantages inherent in the known types of TV dish deicer now present in the prior art, the present invention provides a new satellite antenna deicing device construction wherein the same can be utilized for preventing accumulation of ice and snow upon the reception side of the satellite dish.

The general purpose of the present invention, which will be described subsequently in greater detail, is to provide a new satellite antenna deicing device apparatus and method which has many of the advantages of the TV dish deicer mentioned heretofore and many novel features that result in a new satellite antenna deicing device which is not anticipated, rendered obvious, suggested, or even implied by any of the prior art TV dish deicer, either alone or in any combination thereof.

To attain this, the present invention generally comprises a mounting bracket member adapted to be securely fastened to an elongate satellite antenna support member; and also includes an arm member having a first end securely attached to the mounting bracket member and having a second end; and further includes a heating assembly for heating the satellite antenna for the deicing thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new satellite antenna deicing device apparatus and method which has many of the advantages of the TV dish deicer mentioned heretofore and many novel features that result in a new satellite antenna deicing device which is not anticipated, rendered obvious, suggested, or even implied by any of the prior art TV dish de-icer, either alone or in any combination thereof.

It is another object of the present invention to provide a new satellite antenna deicing device which may be easily and efficiently manufactured and marketed.

It is a further object of the present invention to provide a new satellite antenna deicing device which is of a durable and reliable construction.

An even further object of the present invention is to provide a new satellite antenna deicing device which is susceptible of a low cost of manufacture with regard to both materials and labor, and which accordingly is then susceptible of low prices of sale to the consuming public, thereby making such satellite antenna deicing device economically available to the buying public.

Still yet another object of the present invention is to provide a new satellite antenna deicing device which provides in the apparatuses and methods of the prior art some of the advantages thereof, while simultaneously overcoming some of the disadvantages normally associated therewith.

Still another object of the present invention is to provide a new satellite antenna deicing device for preventing accumulation of ice and snow upon the reception side of the satellite dish.

Yet another object of the present invention is to provide a new satellite antenna deicing device which includes a mounting bracket member adapted to be securely fastened to an elongate satellite antenna support member; and also includes an arm member having a first end securely attached to the mounting bracket member and having a second end; and further includes a heating assembly for heating the satellite antenna for the deicing thereof.

Still yet another object of the present invention is to provide a new satellite antenna deicing device that is easy and simple to set up to effectively heat the reception side of the satellite dish.

Even still another object of the present invention is to provide a new satellite antenna deicing device that allows the user to easily and quickly remove it when during the warm months of the year These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
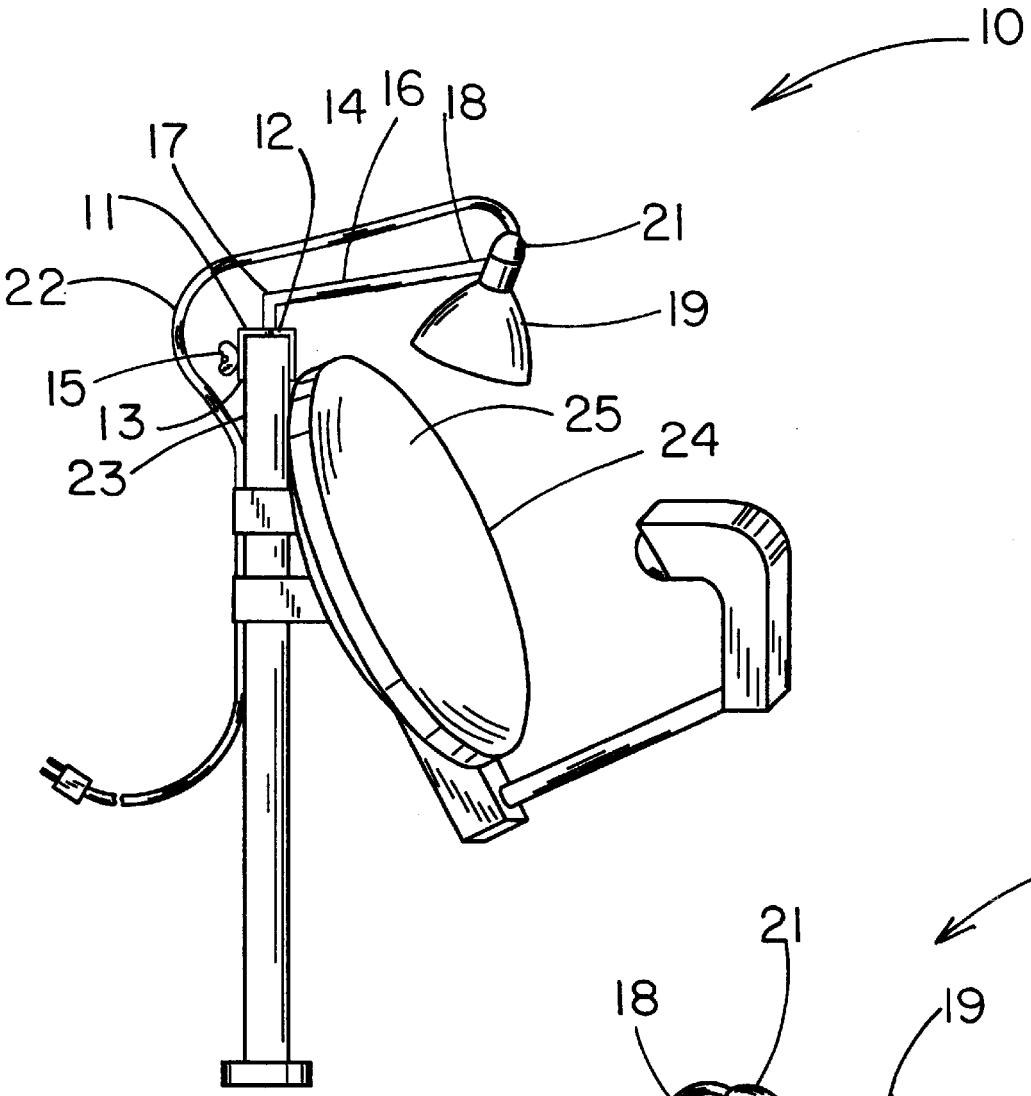
FIG. 1 is a perspective view of a new satellite antenna deicing device according to the present invention shown in use.
Figure 2:
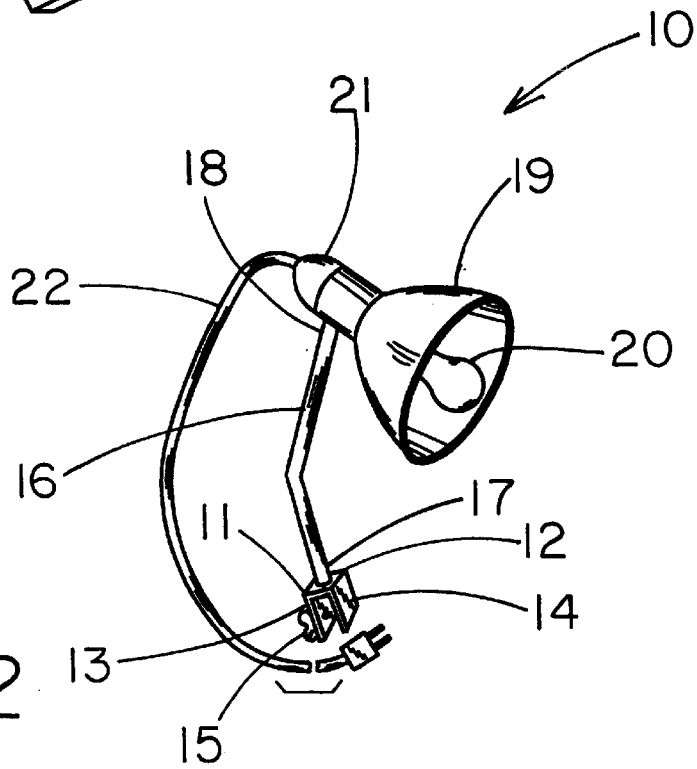
FIG. 2 is a perspective view of the present invention.

With reference now to the drawings, and in particular to FIGS. 1 through 2 thereof, a new satellite antenna deicing device embodying the principles and concepts of the present invention and generally designated by the reference numeral 10 will be described.

As best illustrated in FIGS. 1 through 2, the satellite antenna deicing device 10 generally comprises a mounting bracket member 11 adapted to be securely fastened to an elongate satellite antenna support member 23 such as a pole. The mounting bracket member 11 includes a U-shaped member 12 having end portions 13,14 which are spaced apart and which are adapted to extend about a portion of the elongate satellite antenna support member 23, and also includes a fastener 15 which is threaded through at least one of the end portions 13 of the U-shaped member 12 and which is adapted to engage the elongate satellite antenna support member 23.

The satellite antenna deicing device 10 also comprises an arm member 16 having a first end 17 securely and conventionally attached to the mounting bracket member 11 and having a second end 18. The arm member 16 is adapted to extend beyond a reception side 25 of the satellite antenna 24. A means for heating the satellite antenna 24 for the deicing thereof includes a shroud 19 having an open end and being securely and conventionally attached to the second end 18 of the arm member 16, and also includes a heat-emitting member 20,21 securely and conventionally disposed within the shroud 19 and being adapted to direct heat upon the reception side 25 of the satellite antenna 24, and further includes a power cord 22 securely and conventionally connected to the heat-emitting member 20,21 and being adapted to connect to a power source for energizing the heat-emitting member 20,21. The heat-emitting member 20,21 includes a heating lamp 20 and a socket 21 for removably receiving the heating lamp 20 with the socket 21 being securely and conventionally attached to the shroud 19 and being connected to the power cord 22.

In use, the user plugs in the power cord 22 into a suitable electrical outlet which energizes the heat lamp 20 which emits heat radiation upon the reception side of the satellite antenna 24 to effectively de-ice the satellite antenna 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A satellite antenna deicing device comprising:

a mounting bracket member adapted to be securely fastened to an elongate satellite antenna support member;

an arm member having a first end securely attached to said mounting bracket member and having a second end;

a means for heating the satellite antenna for the deicing thereof; and said mounting bracket member including a U-shaped member having end portions which are spaced apart and which are adapted to extend about a portion of the elongate satellite antenna support member; and also includes a fastener which is threaded through at least one of said end portions of said U-shaped member and which is adapted to engage the elongate satellite antenna support member.

2. A satellite antenna deicing device as described in claim 1, wherein said arm member is adapted to extend beyond a reception side of the satellite antenna.

3. A satellite antenna deicing device as described in claim 1, wherein said means for heating the satellite antenna includes a shroud having an open end and being securely attached to said second end of said arm member; and also includes a heat-emitting member securely disposed within said shroud and being adapted to direct heat upon the reception side of the satellite antenna; and further includes a power cord securely connected to said heat-emitting member and being adapted to connect to a power source for energizing said heat-emitting member.

4. A satellite antenna deicing device as described in claim 3, wherein said heat-emitting member includes a heating lamp and a socket for removably receiving said heating lamp, said socket being securely attached to said shroud and being connected to said power cord.

5. A satellite antenna deicing device comprising:

a mounting bracket member adapted to be securely fastened to an elongate satellite antenna support member, said mounting bracket member including a U-shaped member having end portions which are spaced apart and which are adapted to extend about a portion of the elongate satellite antenna support member, and also including a fastener which is threaded through at least one of said end portions of said U-shaped member and which is adapted to engage the elongate satellite antenna support member;

an arm member having a first end securely attached to said mounting bracket member and having a second end, said arm member being adapted to extend beyond a reception side of the satellite antenna; and a means for heating the satellite antenna for the deicing thereof including a shroud having an open end and being securely attached to said second end of said arm member, and also including a heat-emitting member securely disposed within said shroud and being adapted to direct heat upon the reception side of the satellite antenna, and further including a power cord securely connected to a power source for energizing said heat-emitting member, said heat-emitting member including a heating lamp and a socket for removably receiving said heating lamp, said socket being securely attached to said shroud and being connected to said power cord.

6. A satellite antenna deicing device comprising:

a mounting bracket member adapted to be securely fastened to an elongate satellite antenna support member;

an arm member having a first end securely attached to said mounting bracket member and having a second end;

a means for heating the satellite antenna for the deicing thereof; and wherein said means for heating the satellite antenna includes a shroud having an open end and being securely attached to said second end of said arm member; and also includes a heat-emitting member securely disposed within said shroud and being adapted to direct heat upon the reception side of the satellite antenna; and further includes a power cord securely connected to said heat-emitting member and being adapted to connect to a power source for energizing said heat-emitting member.

7. A satellite antenna deicing device as described in claim 6, wherein said heat-emitting member includes a heating lamp and a socket for removably receiving said heating lamp, said socket being securely attached to said shroud and being connected to said power cord.

* * * * *